US007207155B2

(12) United States Patent
Draghetti et al.

(10) Patent No.: US 7,207,155 B2
(45) Date of Patent: Apr. 24, 2007

(54) METHOD OF PACKING PACKETS OF CIGARETTES USING A SHEET OF PACKING MATERIAL FOR IMPLEMENTING SUCH A METHOD

(75) Inventors: Fiorenzo Draghetti, Medicina (IT); Silvano Boriani, Bologna (IT); Ivanoe Bertuzzi, Casalecchio Di Reno (IT)

(73) Assignee: G. D Societa' per Azioni, Bologna (IT)

( * ) Notice: Subject to any disclaimer, the term of this patent is extended or adjusted under 35 U.S.C. 154(b) by 70 days.

(21) Appl. No.: 10/511,386

(22) PCT Filed: Apr. 17, 2003

(86) PCT No.: PCT/EP03/50113

§ 371 (c)(1),
(2), (4) Date: May 25, 2005

(87) PCT Pub. No.: WO03/089336

PCT Pub. Date: Oct. 30, 2003

(65) Prior Publication Data

US 2005/0210837 A1 Sep. 29, 2005

(30) Foreign Application Priority Data

Apr. 19, 2002 (IT) ..... BO2002A0210

(51) Int. Cl.

| | |
|---|---|
| ***B65B 19/00*** | (2006.01) |
| ***B65B 11/00*** | (2006.01) |
| ***B65B 51/10*** | (2006.01) |
| *B65D 85/10* | (2006.01) |

(52) U.S. Cl. ..... 53/411; 53/444; 53/447; 53/462; 53/463; 206/273; 206/274; 206/459.5

(58) Field of Classification Search ..... 53/411, 53/415, 444, 447, 462, 463, 207; 206/271, 206/273, 274, 459.5

See application file for complete search history.

(56) References Cited

U.S. PATENT DOCUMENTS

| | | | | |
|---|---|---|---|---|
| 2,149,400 | A * | 3/1939 | Mazer | 53/207 |
| 2,994,167 | A * | 8/1961 | Chalmers | 53/462 |
| 3,027,998 | A | 4/1962 | Ridgway | |
| 3,051,305 | A | 8/1962 | Houle | |
| 3,278,016 | A | 10/1966 | Conti | |
| 3,332,207 | A * | 7/1967 | Midnight | 53/207 |
| 3,746,242 | A * | 7/1973 | Troth | 229/122.32 |
| 3,809,227 | A | 5/1974 | Begemann | |
| 4,388,794 | A * | 6/1983 | Focke et al. | 53/389.3 |
| 4,774,798 | A * | 10/1988 | Wallin | 53/462 |

(Continued)

*Primary Examiner*—Stephen F. Gerrity
(74) *Attorney, Agent, or Firm*—Ladas and Parry LLP

(57) ABSTRACT

A method of packing packets (2) of cigarettes, in particular an orderly group (1) of packets (2) of cigarettes, wherein the orderly group (1) is packed solely in a sheet (11) of transparent heat-seal plastic packing material, which is folded about the orderly group (1) to form a tubular wrapping having two tubular portions (21) projecting with respect to the orderly group (1), each tubular portion (21) being defined by four flaps (18*b*, 18*c*, 18*d*, 18*f*) facing in pairs; the flaps (18*b*, 18*c*, 18*d*, 18*f*) are folded squarely onto the orderly group (1) in a given sequence, so as to at least partly superimpose the flaps (18*b*, 18*c*, 18*d*, 18*f*); and the superimposed flaps (18*b*, 18*c*, 18*d*, 18*f*) are then sealed.

14 Claims, 2 Drawing Sheets

U.S. PATENT DOCUMENTS 4,784,261 A 11/1988 Kutchin
5,985,360 A * 11/1999 Boriani et al. ..... 427/207.1
6,244,017 B1 * 6/2001 Focke et al. ..... 53/147
6,338,410 B1 * 1/2002 Wasmund ..... 206/778
6,675,556 B2 * 1/2004 Bertuzzi et al. ..... 53/234
2002/0177513 A1 * 11/2002 Focke et al. ..... 493/63
2003/0119644 A1 * 6/2003 Draghetti et al. ..... 493/480

* cited by examiner

METHOD OF PACKING PACKETS OF CIGARETTES USING A SHEET OF PACKING MATERIAL FOR IMPLEMENTING SUCH A METHOD

TECHNICAL FIELD

The present invention relates to a method of packing packets of cigarettes.

More specifically, the present invention relates to a method of packing an orderly group of packets of cigarettes in a sheet of packing material to form a carton of cigarettes, to which the following description refers purely by way of example.

BACKGROUND ART

Cartons of cigarettes normally comprise ten packets of cigarettes arranged in an orderly parallelepiped-shaped group, which is enclosed in a sheet of paper or in a cardboard blank, and is then wrapped in a sheet of transparent heat-seal plastic material, normally polypropylene.

Each packet of cigarettes is printed on the outer surface with the trademark and brand name of the cigarettes, maker's details, and all compulsory information required by law, and which, in particular, comprises the content of the cigarettes and a government health warning.

Since legal requirements vary from one country to another, the information printed on the packet must be adapted accordingly.

And the same also applies to cartons, so that the carton packing material (sheet of paper or cardboard blank) must be adapted to each individual country.

U.S. Pat. No. 4,784,261 discloses a cigarette package having a desired number of individual packets which are wrapped by a clear cellophane wrapper to provide a single package; each of the individual packets contains a predetermined quantity of cigarettes. An advertising card is provided between the individual packets which in turn forms a part of the completed package upon wrapping of the package itself.

DISCLOSURE OF INVENTION

It is an object of the present invention to provide a method of packing packets of cigarettes, designed to reduce the cost of conforming with the legal requirements of individual countries.

According to the present invention, there is provided a method of packing packets of cigarettes.

The present invention also relates to a sheet of packing material for implementing the packing method.

According to the present invention, there is provided a sheet of packing material.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
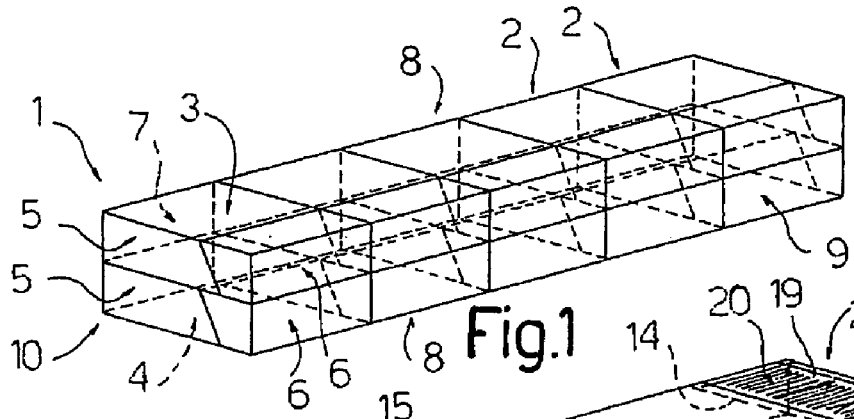
FIG. 1 shows a view in perspective, with parts removed for clarity, of an orderly group of packets of cigarettes.

Number 1 in FIG. 1 indicates as a whole an orderly group of ten packets 2 of cigarettes. Each packet 2 of cigarettes comprises a front face 3, a rear face 4, two lateral faces 5, a top face 6, and a bottom face 7. Packets 2 in group 1 are arranged in two superimposed layers, each comprising five equioriented packets 2 arranged side by side along respective lateral faces 5. The layers are superimposed so that the front faces 3 in the bottom layer contact the rear faces 4 in the top layer, and group 1 is therefore in the form of a parallelepiped having two main faces 8 defined respectively by front faces 3 and rear faces 4 of five adjacent packets 2; two lateral faces 9 defined respectively by top faces 6 and bottom faces 7 of the ten packets 2 defining group 1; and two end faces 10, each defined by the lateral faces 5 of the two end packets 2.

Figure 7:
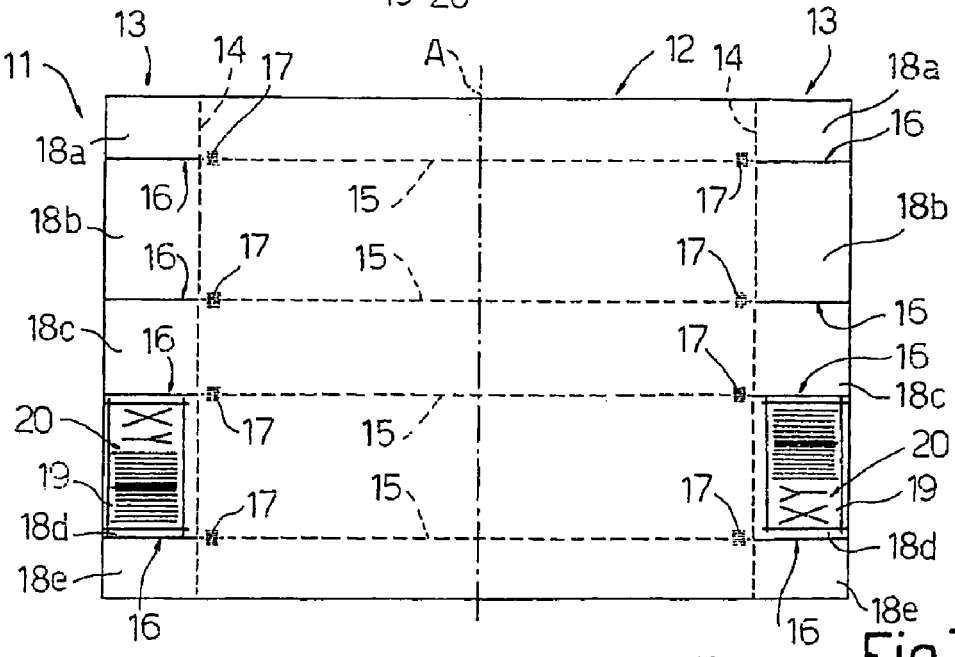
FIG. 7 shows a spread-out plan view of a sheet of packing material in accordance with the present invention.

With reference to FIG. 7, number 11 indicates a rectangular sheet of packing material made of transparent heat-seal plastic material, in particular polypropylene. Sheet 11 is sized to fully enclose orderly group 1 of packets 2 of cigarettes, extends along an axis A, and comprises a central panel 12 and two lateral panels 13.

Lateral panels 13 are separated from central panel 12 by two ideal fold lines 14 parallel to axis A. Sheet 11 of packing material also comprises four ideal fold lines 15 perpendicular to axis A and extending solely along central panel 12. The ideal extension of ideal fold lines 15 along lateral panels 13 is defined by slits 16, each of which has one end along the edge of sheet 11 and one end along ideal fold line 14, and is defined by a cut in sheet 11 of packing material.

Figure 8:
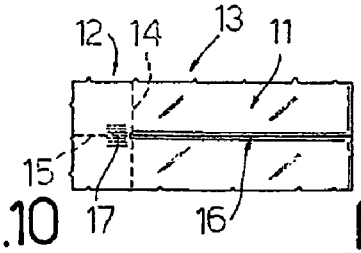
FIG. 8 shows a larger-scale plan view, with parts removed for clarity, of a detail of the sheet of packing material in FIG. 7.

With reference to FIG. 8, at the end of each slit along relative fold line 14, sheet 11 of packing material has a hardened portion 17, formed in central panel 12 by locally heating sheet 11 of packing material, to prevent slit 16 from initiating tearing of sheet 11.

With reference to FIG. 7, slits 16 divide each lateral panel 13 into portions 18*a*, 18*b*, 18*c*, 18*d* and 18*e*, which, in use, are folded onto an end face 10 of group 1.

Each portion 18*d* has a non-transparent portion 19 with graphics 20, in particular a bar code and, possibly, a reference number.

Figure 2:
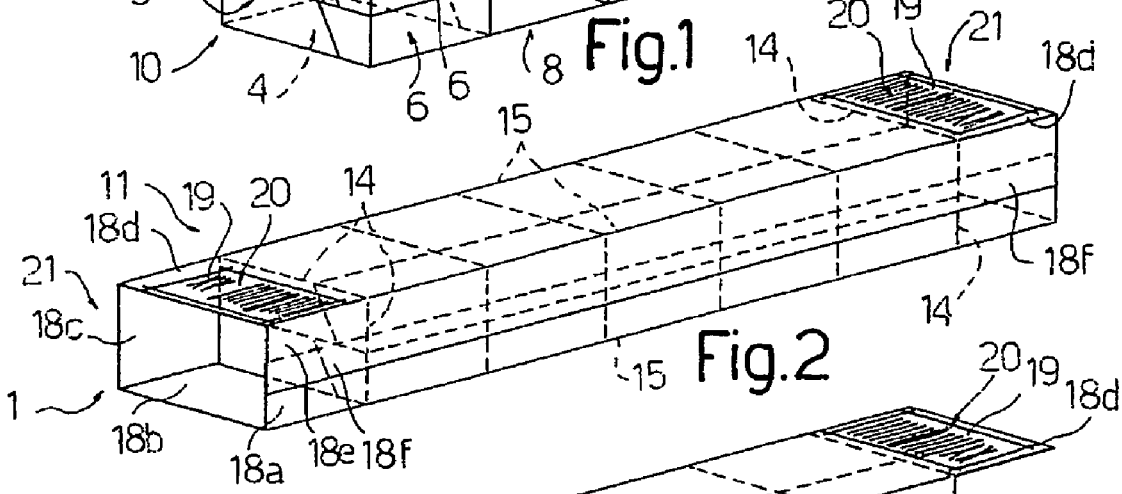
FIGS. 2 to 4 show views in perspective of the orderly group in FIG. 1 wrapped partly in a sheet of packing material.

With reference to FIG. 2, sheet 11 of packing material is folded about group 1 of packets 2 of cigarettes to form a tubular wrapping. That is, central panel 12 is folded about faces 8 and 9, so that each ideal fold line 15 extends along a respective edge of adjacent faces 8 and 9, and the opposite ends of sheet 11 perpendicular to axis A are superimposed. At the same time, ideal fold lines 14 extend along the edges formed by end faces 10 with faces 8 and 9, so that lateral panels 13 of sheet 11 of packing material form two tubular portions 21 projecting from opposite ends of group 1. Each tubular portion 21 comprises two parallel, facing flaps 18*b* and 18*d*, and two parallel, facing flaps 18*c* and 18*f*, wherein flap 18*f* is defined by overlapping portions 18*a* and 18*e*, while flaps 18*b*, 18*c* and 18*d* correspond to the portions indicated by the same reference numbers.

Figure 3:
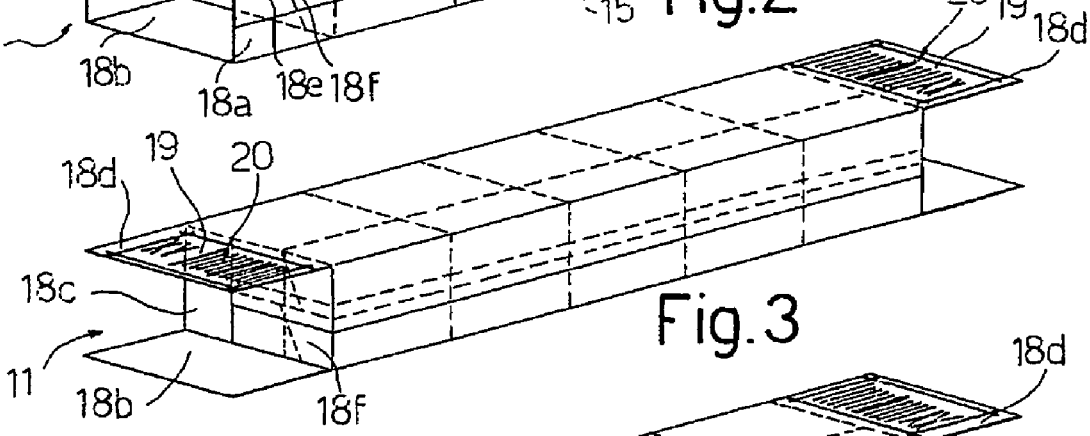
Figure 4:
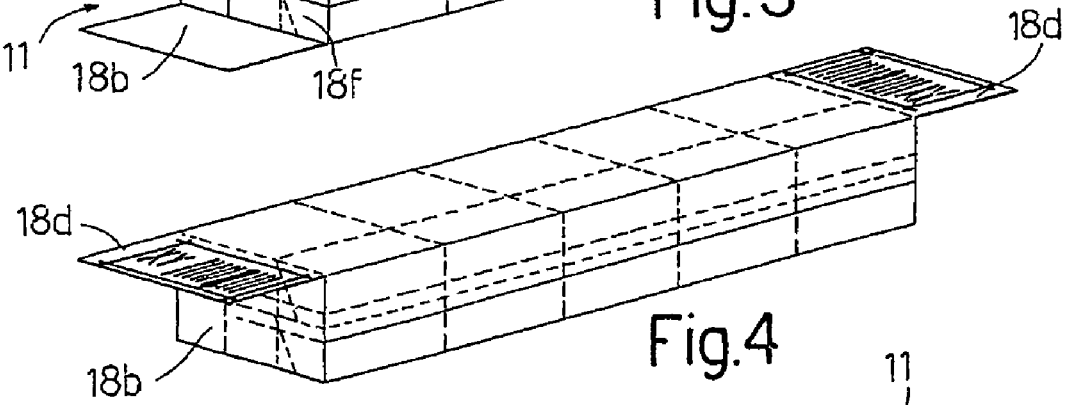
Figure 5:
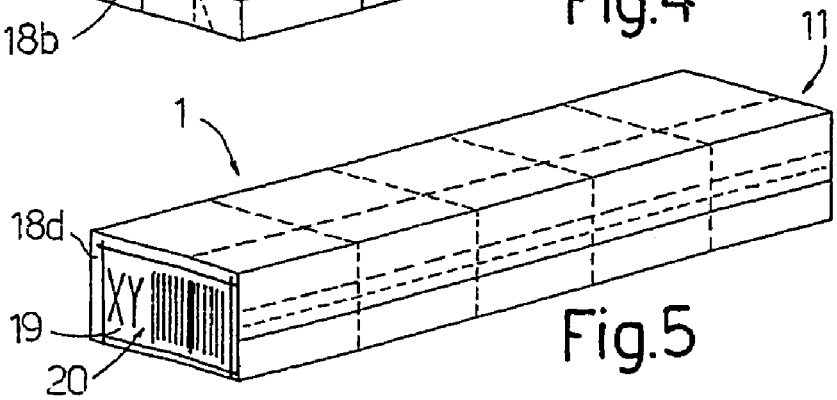
FIG. 5 shows a view in perspective of the orderly group in FIG. 1 fully wrapped in the sheet of packing material.

At the next steps in the packing of group 1, flaps 18*c* and 18*f* are folded squarely one on top of the other onto face 10 (FIG. 3), flap 18*b* is folded squarely onto flaps 18*c* and 18*f* (FIG. 4), and flap 18*d* is folded onto flat 18*b* (FIG. 5). In other words, flaps 18*b* and 18*d* are the same size as end face 10 of group 1, so that, once folding is completed, each end face 10 is covered completely by a respective flap 18*d*, and the superimposed parts of sheet 11 are then sealed.

Figure 6:
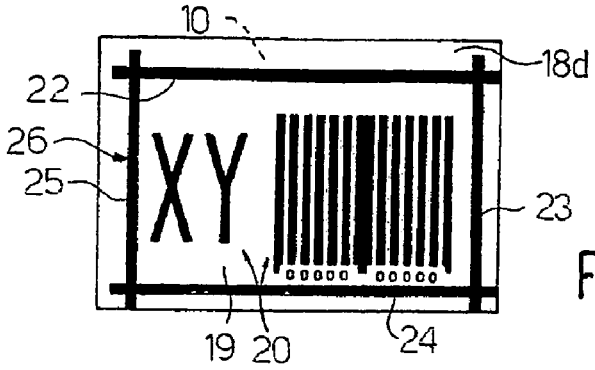
FIG. 6 shows a side view of the orderly group in FIG. 5 with the sheet of packing material heat sealed.

With reference to FIG. 6, end face 10 is covered by superimposed flaps 18*b*, 18*c*, 18*d* and 18*f*, and flap 18*d*, which is the last to be folded down, defines the whole of the outside of end face 10. Sealing is effected by locally melting sheet 11 of packing material around flap 18*d*, so as to form, around flap 18*d*, bead seals 22, 23, 24 and 25. Bead seals 22, 23, 24 and 25 extend around, so as not to interfere with, graphics 20, are so arranged as to form an endless path 26 surrounding graphics 20, overlap at opposite ends, and are located close to respective edges defined by face 10 with faces 8 and 9.

Figure 9:
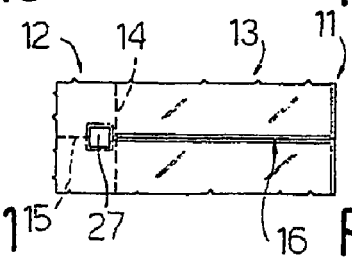

With reference to the FIG. 9 variation, as opposed to a hardened portion 17 for each slit 16, sheet 11 has an adhesive label 27 located along central panel 12, close to the end of slit 16 along ideal fold line 14, to prevent sheet 11 from tearing.

Figure 10:
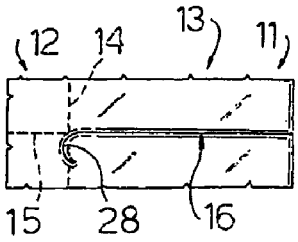
FIGS. 9, 10, 11 and 12 show larger-scale plan views, with parts removed for clarity, of variations of the FIG. 8 detail.

In the FIG. 10 variation, slit 16 has a hooked end 28 along fold line 14.

Figure 11:
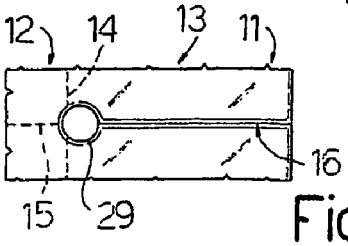

In the FIG. 11 variation, the end of slit 16 is defined by a circular opening 29 along ideal fold line 14. That is, sheet 11 is perforated, by blanking or melting, at the end of slit 16 along ideal fold line 14. Melting comprises forming and hardening the edge of opening 29 by approaching the portion of sheet 11 for perforating with the end of a heated rod, and provides for more effective tear resistance.

Figure 12:
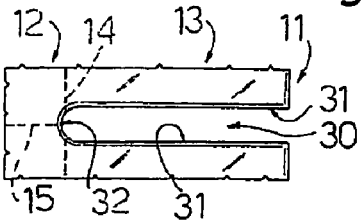

In the FIG. 12 variation, slit 16 is defined by a slot 30 having two opposite edges 31 connected by a semicircle 32 at the end along fold line 14. Slot 30 may be formed by blanking or melting.

In another variation not shown, only one lateral panel 13 has slits 16, the other lateral panel 13 being whole, and the relative tubular portion being closed by forming pleats.

In another variation not shown, only portion 18*d* with graphics 20 is detached by slits 16 from the rest of lateral panel 13.

Regardless of the form of, and the means employed to produce, slits 16, each sheet 11 of packing material is formed from a web of polypropylene (not shown) on a packing machine (not shown).

Sheet 11 of packing material is first detached from the web, and slits 16 then formed as shown in any one of FIGS. 8 to 12.

In one variation, slits 16 are formed before sheet 11 of packing material is detached from the web.

The variations of slit 16 shown in FIGS. 8 to 12 can all be obtained by cutting, blanking, or combined cutting and blanking; and opening 29 and slot 30 can be obtained indifferently by blanking or melting.

All the above operations are performed on the packing machine (not shown) from which the web (not shown) is unwound.

Combined with the method described, sheet 11 of packing material has various advantages. In particular, it provides for packing group 1 of packets 2 of cigarettes into a carton with a single, as opposed to a double, wrapping, and allows visibility of the content of the carton, and the compulsory information, brand name and trademark on packets 2. Moreover, since each carton has distinctive markings, such as a bar code indicating the price of the carton as a whole, the end faces of the carton can be used for this purpose, by the sheet of packing material at the end faces having no pleats or seals affecting legibility of the bar code.

The invention claimed is:

1. A method of packing an orderly group (1) of packets (2) of cigarettes; the method comprising the steps of folding a sheet (11) of heat-seal transparent plastic packing material about the orderly group (1) to form a tubular wrapping having two tubular portions (21) projecting with respect to the orderly group (1), each tubular portion (21) comprising four flaps (18*b*, 18*c*, 18*d*, 18*f*), folding each flap (18*b*, 18*c*, 18*d*, 18*f*) onto the orderly group (1), so as to at least partly superimpose said flaps (18*b*, 18*c*, 18*d*, 18*f*), and sealing the superimposed flaps (18*b*, 18*c*, 18*d*, 18*f*) to one another; the orderly group (1) being packed solely in the sheet (11) of transparent packing material, so that the packets (2) are visible through the sheet (11) of packing material; the method being characterized in that at least an outer flap (18*d*) has a portion (19) bearing graphics (20) and said flaps (18*b*, 18*c*, 18*d*, 18*f*) are sealed by melting the sheet (11) of packing material to define at least one bead seal (22, 23, 24, 25) outwards of said graphics (20).

2. A method as claimed in claim 1, wherein said orderly group (1) has two main faces (8), two lateral faces (9), and two end faces (10); said flaps (18*b*, 18*c*, 18*d*, 18*f*) being superimposed on said end faces (10).

3. A method as claimed in claim 1, wherein said at least one bead seal (22, 23, 24, 25) defines an endless path (26) surrounding said graphics (20).

4. A method as claimed in claim 3, wherein said endless path (26) is defined by a number of adjacent bead seals (22, 23, 24, 25).

5. A method as claimed in claim 4, wherein said adjacent bead seals (22, 23, 24, 25) overlap.

6. A method as claimed in claim 3, wherein each said bead seal (22, 23, 24, 25) is located close to an edge of said orderly group (1).

7. A method as claimed in claim 1, wherein said sheet (11) of packing material comprises a central panel (12), and two lateral panels (13) separated ideally from the central panel (12) by two ideal fold lines (14); the method comprising forming slits (16) along the lateral panels (13), and which extend between the edges of the sheet (11) of packing material and said ideal fold lines (14) to define a number of portions (18*a*, 18*b*, 18*c*, 18*d*, 18*e*) defining said flaps (18*b*, 18*c*, 18*d*, 18*f*).

8. A method as claimed in claim 7, wherein each slit (16) is formed by cutting said sheet (11) of packing material.

9. A method as claimed in claim 8, wherein a portion (17) of said sheet (11) of packing material at one end of said slit (16) is thermally perforated and hardened.

10. A method as claimed in claim 8, wherein an adhesive label (27) is applied to said sheet (11) of packing material at one end of said slit (16).

11. A method as claimed in claim 7, wherein each slit (16) is formed by cutting and blanking to remove part of the sheet (11) of packing material.

12. A method as claimed in claim 11, wherein each slit (16) is formed by cutting said sheet (11) of packing material, combined with melting the slit (16) at one end of the slit (16).

13. A method as claimed in claim 11, wherein each slit (16) is formed by melting part of said sheet (11) of packing material.

14. A method as claimed in claim 7, wherein the sheet (11) is detached of packing material from a continuous web of heat-seal plastic material.

* * * * *